United States Patent [19]

Rovsek

[11] Patent Number: 4,500,091

[45] Date of Patent: Feb. 19, 1985

[54] GAME BOX

[76] Inventor: Edward Rovsek, 1822 Heights St., P.O. Box 21, Brooklyn, Mich. 49230

[21] Appl. No.: 590,394

[22] Filed: Mar. 16, 1984

[51] Int. Cl.[3] ..... A63F 3/00

[52] U.S. Cl. ..... 273/269; 273/148 R; 273/286

[58] Field of Search ..... 206/409; 222/288; 232/44; 273/148 R, 240, 269, 286, 309; 434/412

[56] References Cited

U.S. PATENT DOCUMENTS

| | | | |
|---|---|---|---|
| 1,127,594 | 2/1915 | Cooper | 273/286 X |
| 2,500,824 | 3/1950 | Horvath | 273/286 |
| 2,784,973 | 3/1957 | Nemec | 273/309 |
| 2,872,215 | 2/1959 | Taylor | 273/286 X |
| 3,811,680 | 5/1974 | Benesch | 273/309 |
| 4,257,610 | 3/1981 | Ptaszek | 273/286 X |

FOREIGN PATENT DOCUMENTS

| | | | |
|---|---|---|---|
| 329321 | 2/1903 | France | 273/286 |

OTHER PUBLICATIONS

"Glad Wrap" Brand Plastic Wrap Box.

*Primary Examiner*—Harland S. Skogquist
*Attorney, Agent, or Firm*—Cullen, Sloman, Cantor, Grauer, Scott & Rutherford

[57] ABSTRACT

In combination a game holder box having a cover mountable upon a support and adapted to store markers, chips or tokens, and a flexible strip overlying the support and adapted to mount the markers selectively over its surface and at one end secured to the box. The other end of the strip is adapted for gripping on opposite sides forming an elongated chute when the sides are elevated and brought towards each other, the markers sliding and flipped into the box. The strip may have indicia thereon defining a game board.

14 Claims, 8 Drawing Figures

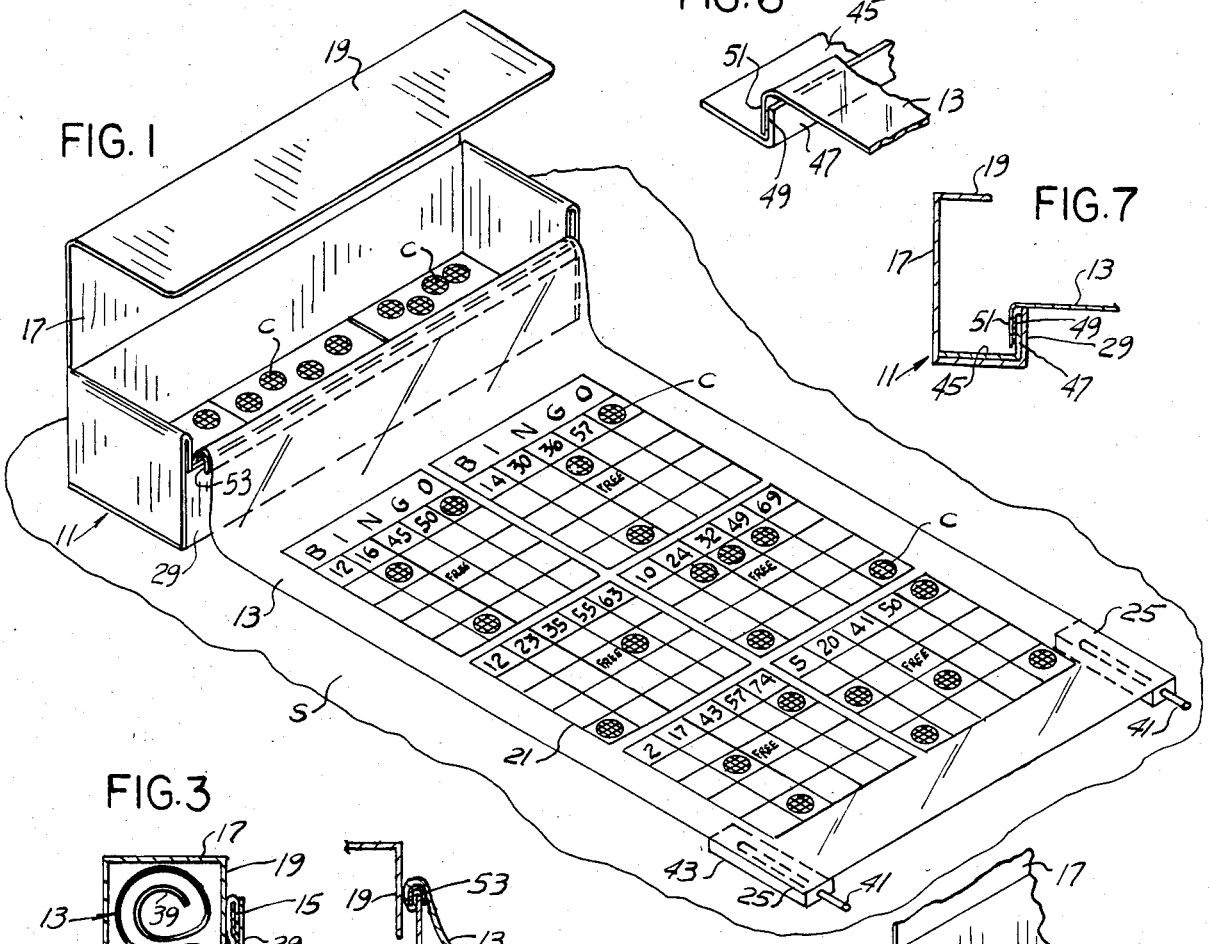
FIG. 1
B I N G O
FREE
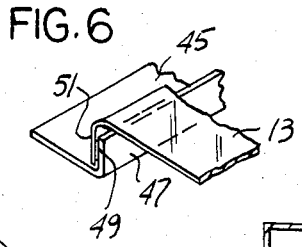
FIG. 6
FIG. 7
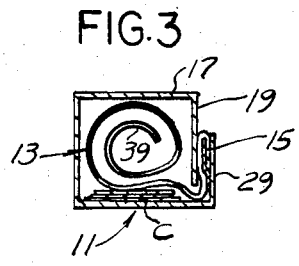
FIG. 3
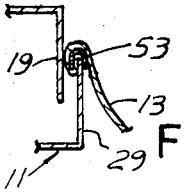
FIG. 8
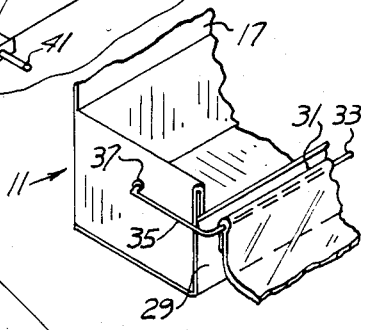
FIG. 4
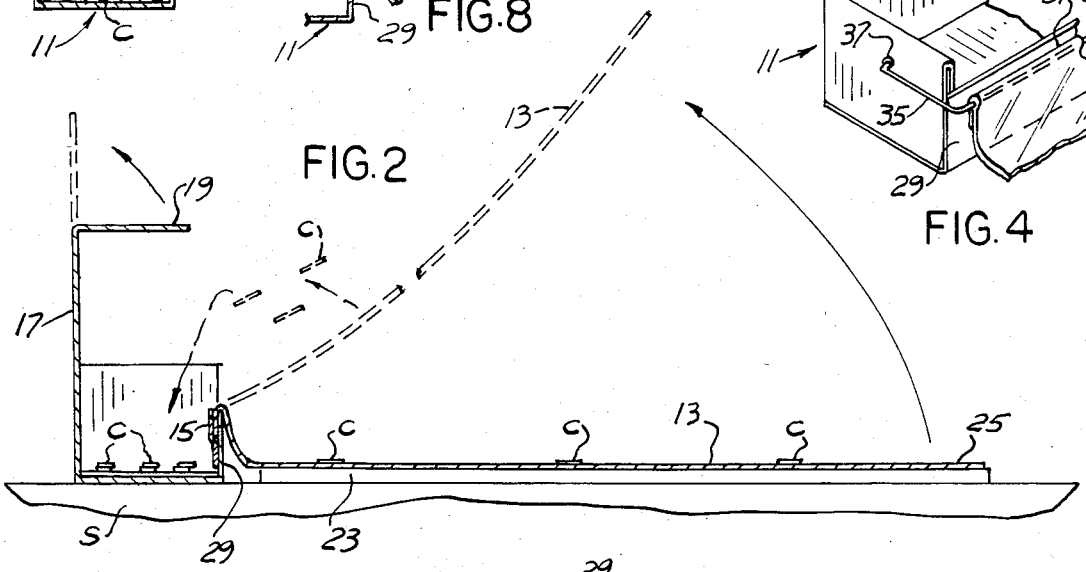
FIG. 2
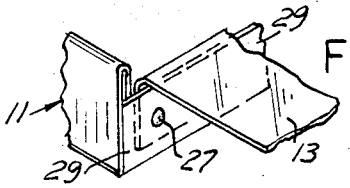
FIG. 5

GAME BOX

BACKGROUND OF THE INVENTION

1. Field of the Invention

The present invention relates to games and particularly any game using markers, chips or tokens in conjunction with a game board wherein the game board chips may be normally stored within a box when not in use.

2. The Prior Art

Game boxes with markers and game boards are shown in one or more of the following United States Patents:

| U.S. PAT. NO. | PATENT NAME | PATENT DATE |
|---|---|---|
| Horvath | 2,500,824 | March 14, 1950 |
| Taylor | 2,872,215 | February 3, 1959 |
| Knott | 4,212,468 | July 15, 1980 |

Heretofore in playing of such games as bingo, checkers and Scrabble and other related games, there are employed similar or dissimilar tokens, markers or chips which are applied to a game board selectively and after a particular game must be separately cleared from the game board for restarting the game, or for storing thereof within an appropriate container.

Heretofore, particularly in the playing of bingo, wherein a player may have one or a large number of game boards in front of him, tokens are manually and selectively distributed over the game board or game boards in accordance with a predetermined calling of numbers. The interval between the end of one game and the start of another game is limited so that there is a need for the fast removal of the chips from the game boards for collection and re-use. Often there have been employed magnetic wands for sweeping over the boards and for picking up the chips and placing them someplace reasonably convenient to the user for re-use or storage.

SUMMARY OF THE INVENTION

An important feature of the present invention is to provide in combination a game holder box for a plurality of markers, chips or tokens and an elongated strip of flexible material which overlies a support, such as a table and is adapted to have markers mounted thereon selectively over at its surface during playing of a game. One end of the strip extends to and is secured to an open box, and the other end of the strip is adapted for grasping on opposite sides forming a chute when the sides are elevated and moved towards each other, with the markers sliding and being manually flipped into the box for re-use or for storage.

Another feature is to provide an elongated flexible strip of material or plastic onto which indicia is imprinted for defining one or more game boards directly onto the strip.

Another feature is to provide an elongated strip of a transparent material adapted to overlie a game board upon a support surface and wherein the markers are selectively positioned upon the strip in registry with the underlying indicia of the game board.

An important feature contemplates the securing of the one end of the flexible strip of material to the box upon one side thereof and provides a guided path for the delivery of markers into the box for collection or storage therein, wherein the opposite sides of the strip at its other end are brought together and elevated to define a chute. The markers will slide by gravity and are adapted for flipping into the box.

As another feature, a plurality of bingo game boards are imprinted upon the elongated strip whereby a plurality of bingo games may be played at one time and wherein the strip when formed into a chute provides a quick means of clearing all of the game boards for the next game without unnecessary delay.

As a further feature the elongated game holder box has a hinged cover and flap which when opened serves as a backstop to facilitate the sliding and flipping of the markers back into the box at the end of each game.

Another feature contemplates the elongated strip being rolled into cylindrical form or folded for storage within the box, when not in use, along with the markers thereby defining a self-contained game holder and carrying case.

These and other objects and features will be seen from the following specification and claims in conjunction with the appended drawing.

THE DRAWING

FIG. 1 is a perspective view of the present game box and game board defining flexible strip as mounted upon a support fragmentarily shown.

FIG. 2 is a longitudinal section of a modification for illustrating in phantom lines the formation of the game board strip into a chute clearing the markers from the strip which overlies a game board.

FIG. 3 is a transverse section of the box of FIG. 1, and with the markers and game board strip stored therein.

FIG. 4 is a front perspective fragmentary view of a modified game box.

FIG. 5 is a fragmentary perspective view of a further modified game box.

FIG. 6 is a fragmentary perspective view of a box insert anchor for the flexible strip.

FIG. 7 is a transverse section of the box with the insert anchor in place.

It will be understood that the above drawing illustrates merely several preferred embodiments of the invention and that other emobidments are contemplated within the scope of the claims hereafter set forth.

DETAILED DESCRIPTION OF AN EMBODIMENT OF THE INVENTION

Referring to the drawing, the present game holder box 11, preferably elongated and square or rectangular in cross-section is mountable upon a support S, such as a table, FIG. 1.

An elongated flexible strip 13, sometimes hereafter referred to a chip chute 13, overlies support S and is adapted to mount thereon a plurality of markers C, which may be tokens or chips for any particular game.

Strip 13, which may be of a plastic material such as polypropylene or which of any flexible fabric, at one end projects into said box along the box length and is suitably secured thereto at 15, FIGS. 2 and 3. Said fastening may be by adhesive, pressure sensitive tape or any other suitable attachment which is regarded as equivalent such as snap fasteners 27, FIG. 5, or by the use of an anchor rod 33, FIG. 4 or staples, or a plastic clip 53.

Game holder box 11 includes the hinged cover 17 having a hinged closure flap 19 which during playing of a particular game is in the raised open position, FIG. 1. When the game is not in use, the strip 13 or chip chute is folded or rolled up as at 39, FIG. 3, and is stored with the markers C within the game holder box 11. The cover overlies the box and the flap is projected thereinto upon the interior of the front wall 29.

As shown in FIG. 1, the strip 13, preferably rectangular in shape, has indicia 21 imprinted thereon in the form of a game board or a plurality of game boards, such as a plurality of bingo boards shown the illustrative embodiment. It is contemplated as equivalent that in the case the strip has the game board imprinted thereon, that it could be for any other game using markers such as a checker game board, a game board for Scrabble (TM) or any other game board using markers selectively positioned and removable therefrom.

While the game board 21 is imprinted upon the flexible strip 13 or a chip chute in FIG. 1, a modification is shown in FIG. 2 wherein a strip 13 is transparent and overlies a separate game board 23 which is mounted upon support S. In this embodiment, the markers C are selectively applied over the surface of the chip chute 13 and are in registry with the underlying game board for playing any particular game.

The other end of the strip 13 has opposed rear edge portions 25 which are adapted for manual grasping whereby when these edge portions are brought towards each other and elevated with respect to the box, there is defined the present chip chute 13 shown in dash lines, FIG. 2. Here the chips or markers C slide downwardly and are manually flipped into box 11.

This provides a means for the fast clearing of the markers from the game board or boards for storage or for re-use in a succeeding game.

Front wall 29 of game box 11 is cut away along its length and from the top thereof to facilitate assembly of the forward end of the strip 13 thereover and into the box and for securing to the interior of front wall as by suitable fastening means.

Fastening may include adhesive or a pressure sensitive adhesive by which the flexible strip 13 may be removed as desired and replaced with another strip, which may be a game board 21, FIG. 1.

A modified game box is fragmentarily shown in FIG. 5 wherein the forward one end of strip 13 is turned down and secured to the interior of front wall 29 of the box as by two or more snap fasteners 27, one of which is shown.

Various means may be employed for anchoring the forward edge of strip 13 to the front wall of the box in such fashion that upon bringing together of the side portions 25 at the rear of the strip and elevating the strip, there is defined a chip chute for delivering the markers into the box.

In FIG. 4, there is fragmentarily shown a modified game box wherein the forward one end of strip 13 has a transverse loop 31. Anchor rod 33 of U-shape is centrally projected through said loop. Ends 35 of the anchor rod are inturned and project through apertures 37 in the end walls of the box. This provides another means by which the forward end of the strip is connected to the box closely adjacent the cut-away front wall thereof.

In the present invention there is essentially provided in conjunction with the game holder box, which preferably has a cover and a flap, of an elongated strip of flexible material, which may be transparent, wherein the game board 21 is directly applied thereto, or a plurality of such game boards, FIG. 1. Alternatively, the flexible strip 13 of a clear plastic material overlies a game board 23 upon a support or table wherein the markers are selectively positioned upon the strip to directly overlie the game board, FIG. 2.

While the game box is particularly adaptable for Bingo and thus provides a self-contained Bingo game holder and carrying case, there is no limitation as to the nature of the game board involved or the nature of the game.

When not in use and with the markers, chips or tokens stored within the box, in FIG. 3, the flexible chip chute 13, which may be the game board itself is folded or rolled and stored within the box for portability and is ready for its next usage.

Referring to FIG. 1, rear edges 25 of strip 13 have mounted thereon a pair of laterally spaced wire handles 41 which are nested and retained within sleeves 43 adjacent the rear edges. In order to form the chute, the respective handles 41 are gripped and elevated and if desired, brought slightly towards each other.

FIGS. 6 and 7 illustrate another modification by which the flexible strip 13 is anchored to and within the box 11. For this purpose there is provided an insert strip 45 which is of such dimension as to be snugly positioned within box 11 bearing upon its bottom and snugly engaging the interior walls thereof, FIG. 7. Upon and along one edge of insert strip 45 is an upright anchor flange 47 which upon insertion bears against the interior of front wall 29.

The flexibe strip 13 at its forward edge 51, FIG. 6, extends over flange 47 and is suitably secured thereto as by a pressure sensitive tape or a double faced adhesive tape 49. By this construction, there is provided a means by which a particular flexible strip 13 may be removed and replaced such as for a different game and wherein as in FIG. 1, the indicia 21 for the game is imprinted directly upon the strip. When cover 19 is closed to a horizontal position tab 19 will project into the box and bear against the interior surface of anchor flange 47.

Having described my invention, reference should now be had to the following claims:

I claim:

1. In combination, an elongated game holder box having a cover mountable upon a support and adapted to store a plurality of game markers, chips or tokens;

an elongated flexible strip of rectangular shape overlying said support adapted to mount said markers selectively over its surface during playing of a game;

said strip at one end projecting into said box along its length and secured thereto;

the other end of said strip being adapted for grasping on opposite sides forming an elongated chute when said sides are elevated above the box, the markers sliding and flipped into said box.

2. In the game box of claim 1, said strip having indicia thereon defining at least one game board.

3. In the game box of claim 1, said strip being transparent;

and a game board upon said support underlying said strip, the markers adapted for visible registry with said game board.

4. In the game box of claim 1, said strip adapted for formation into a roll for storage within said box.

5. In the game box of claim 1, a hinged cover on the box having a closure flap, said cover and flap when opened defining a back-stop for said markers.

6. In the game box of claim 1, said box having a front wall cut away along its length of a reduced height;

said strip at one end extending over said front wall and secured thereto.

7. In the game box of claim 1, said strip being adhesively secured to said box.

8. In the game box of claim 1, said strip being secured to said box by snap fasteners.

9. In the game box of claim 1, said strip having a transverse loop along its one end;

the securing of said strip to said box including a U-shaped anchor rod projected through said loop, with its ends inturned and projected into the ends of said box.

10. In the game box of claim 1, said strip being of a plastic material.

11. In the game box of claim 1, said game box defining a self contained bingo game holder and carrying case.

12. In the game box of claim 1, said strip having indicia thereon defining a plurality of game boards.

13. In the game box of claim 1, lift handles mounted upon said opposite sides at said other end of said strip to facilitate lifting of said strip and forming a chute therein.

14. In the game box of claim 1, the securing of said flexible strip to said box including an insert strip positioned in the box snugly engaging the bottom and interior walls thereof;

an upright anchor flange along one edge of said insert strip;

the one end of said flexible strip extending over and attached to said flange.

* * * * *